United States Patent [19]

Hanson

[11] 4,436,005

[45] Mar. 13, 1984

[54] ROTARY TORQUE ADAPTER

[76] Inventor: Alan R. Hanson, 10024 Johnson Cir., Bloomington, Minn. 55437

[21] Appl. No.: 356,711

[22] Filed: Mar. 10, 1982

[51] Int. Cl.[3] ..... B25B 23/00; B25G 1/04; B25G 3/00

[52] U.S. Cl. ..... 81/177 G; 81/439; 81/177 UJ

[58] Field of Search ..... 81/177 R, 177 A, 177 G, 81/177 UJ, 177 ST, 177 PP, 177.8, 436, 439, 460; D8/29; 411/403–408, 410

[56] References Cited

U.S. PATENT DOCUMENTS

| | | | |
|---|---|---|---|
| D. 142,054 | 8/1945 | Young | D8/29 |
| D. 245,395 | 8/1977 | Cognevich | D8/29 |
| 1,479,506 | 1/1924 | Kellemen | 81/436 X |
| 2,718,806 | 9/1955 | Clark | 81/177 G X |
| 3,838,614 | 10/1974 | O'Donnell | 81/177 A X |
| 4,108,027 | 8/1978 | Lenker | 81/177 UJ X |
| 4,170,909 | 10/1979 | Wagner | 81/177 ST X |
| 4,262,562 | 4/1981 | MacNeill | 81/177 R X |

FOREIGN PATENT DOCUMENTS

| | | | |
|---|---|---|---|
| 109916 | 10/1917 | United Kingdom | 81/439 |
| 594111 | 11/1947 | United Kingdom | 81/439 |

*Primary Examiner*—Frederick R. Schmidt
*Assistant Examiner*—Debra S. Meislin

[57] ABSTRACT

An adapter device for transmitting rotary energy by means of various drive end portions adapted to fit openings of torque drive tools such as socket wrenches and the like and transfer torque from a rotary torque power source such as a reversible variable speed electric drill for in-line coincident centerlines as well as for non-coincident angularly disposed centerlines such as in a universal joint coupling type action, whereby rotary energy is transmitted to tighten or loosen fastening components such as bolts, nuts, screws, threaded components and the like.

1 Claim, 14 Drawing Figures

ROTARY TORQUE ADAPTER

DESCRIPTION 1. Technical Field

This invention relates to adapter tools for use with rotational energy transmitting tools and more specifically for use with socket tool or ratchet wrench devices and the like which are typically used to impart tightening or loosening forces on nuts, bolts or other threaded fastening devices.

2. Background of the Invention

It has been conventional to furnish with torque or ratchet wrenches and socket tools one or more extensions which extend the drive protuberance of the torque or ratchet wrench. The extensions generally have a square receptacle in one end to fit matingly over the square protuberance or extension of the handle and a square protuberance or extension on the other end to fit matingly into the square receptacle of a wrench or socket tool device. Such tools having extension bars with a square receptacle therein are not readily adaptable to application of rotary force or torque from other than the normal handle without a special adapter having a reliable means of preventing rotary slippage. Extension bars are usually hardened steel with the bar shafts normally being circular in cross section. The large diameter of the extension end with the square receptacle therein, in conjunction with the hardened cylindrical surface, increases the degree of difficulty of adapting such tools to a chuck or gripping device as rotational slippage occurs when attempting to apply rotary turning force of any useful or practical magnitude. For large heavy duty loads where hardened steel parts are utilized for rotational impact forces, more complex multi-piece assemblies are generally used. Tools or adapters with ¼ inch square adapters and spring loaded retainer balls which enable the use of small socket-set tools with variable speed reversible or plain electric drills have recently been made available. No other such adapter or similar devices are known or believed to be available.

SUMMARY OF THE INVENTION

The adapter tool of the present invention is used to tighten or loosen nuts, bolts and similar devices and is positioned between an energy power source and a socket tool. The adapter tool transfers rotational torque force from a power source such as an electric drill to a socket tool device which transfers torque force to the nut or bolt being tightened or loosened depending upon the rotation direction. The electric energy source imparts fast continuous rotational motion thereby decreasing the time required for the rotational threading operation. The adapter tool transmits torque through coincident in-line centerlines of revolution of the adapter tool and the socket tool device and in the preferred embodiment also transmits torque as hereinafter described when the centerlines of the two connected pieces are angularly arranged to each other in an intersecting manner and are not coincident.

BRIEF DESCRIPTION OF THE DRAWINGS

Referring to the accompanying drawings, several embodiments of the present invention are illustrated, wherein.

OBJECTS

Accordingly, it is an object of this invention to provide a novel single piece rotational energy transmitting adapter.

Another object is to provide an adapter capable of being gripped in a torque generating tool without rotational slippage.

A further object is to provide an adapter which is economical to manufacture and easily made.

Another object is to provide a wrench device capable of faster rotational operation than conventional wrenches while also being conveniently usable with electric energy converted into rotational force such as with an electric drill.

Another object is to provide an adapter capable of transmitting rotational torque through either coincident centerline alignment conditions of the torque generating device and the adapter and the socket tool device or through non-coincident centerline alignment conditions of the adapter and the socket tool device.

Another object of this invention is to provide an adapter which enables one-handed use thereby freeing the other hand for positioning or other wrench handling or other functions.

Further objects and advantages of my invention will become apparent from considering the accompanying drawings and ensuing descriptions thereof.

BEST MODE FOR CARRYING OUT THE INVENTION

Figure 1:
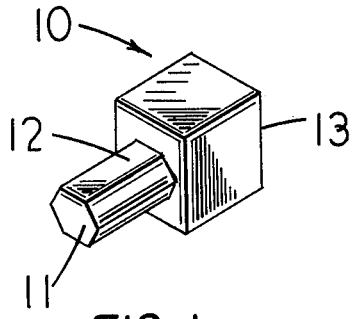
FIG. 1 is a perspective view of one embodiment of my adapter showing one form of drive end and the drive shaft which defines the longitudinal axis of the adapter.
Figure 2:
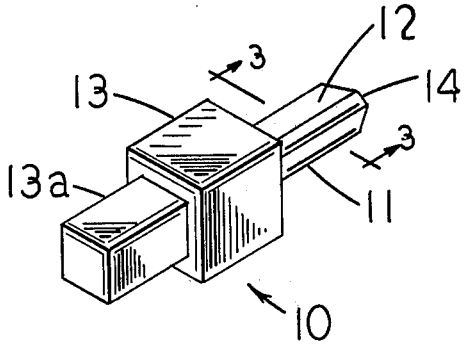
FIG. 2 is a perspective view of another embodiment showing the adapter drive shaft and a combination of a pair of square cross sectional drive end portions.
Figure 3:
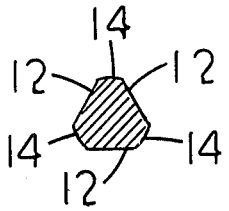
FIG. 3 is a cross section of the geometric configuration of the drive shaft shown in FIG. 2.
Figure 4:
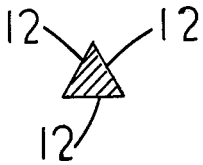
FIG. 4 is a cross section of another geometric configuration or alternative embodiment of the drive shaft shown in FIG. 2.
Figure 5:
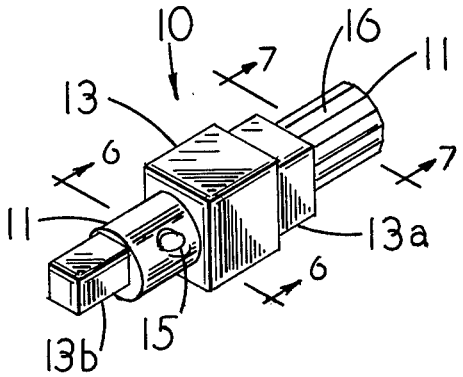
FIG. 5 is a perspective view showing another embodiment of the adapter with a drive shaft having a plurality of cross sectional shapes and more than one size of square cross sectional drives with a plurality of drive shaft embodiments.
Figure 6:
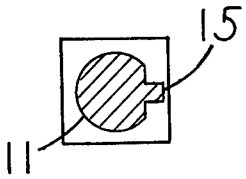
FIG. 6 is a cross section of one of the drive shafts depicted in FIG. 5.
Figure 7:
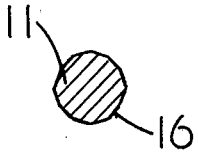
FIG. 7 shows another cross sectional embodiment of one of the drive shafts shown in FIG. 5.
Figure 8:
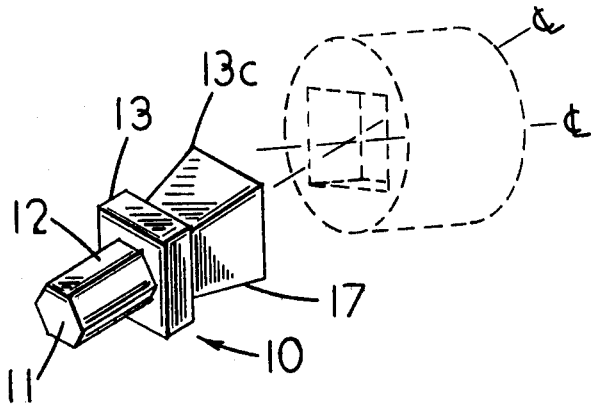
FIG. 8 is a perspective view showing another embodiment of the adapter with a decreasing square cross sectional area truncated quadrangular pyramid drive end portion and a full area drive end portion with the centerline of the adapter angularly disposed with respect to the phantom socket tool device.

With reference to FIG. 1, adapter 10 has a drive shaft 11 with a hexagonal cross section having flat surfaces 12. The hexagonal drive shaft 11 could also have any desired non-round geometric shape that is compatible with chucks typically used with electric drills, or compatible with whatever torque tool is being utilized. One alternative embodiment envisioned consists of three flat surfaces forming a cross sectional equilateral triangle with three arcs 14 of a circle connecting the three flat surfaces 12 as shown in FIG. 3. This drive shaft configuration is also depicted as drive shaft 11 of adapter 10 as shown in FIG. 2. Another embodiment of the drive shaft 11 could also consist of three flat surfaces 12 having the cross section of an equilateral triangle as shown in FIG. 4. Another cross sectional configuration is the outwardly forged or upset projection 15 as shown in FIG. 5, or more clearly shown in cross section in FIG. 6. The single outwardly forged or upset projection 15 may also consist of a plurality, but preferably two or three outwardly forged or upset projections 15 spaced equidistant around the drive shaft 11. The drive shaft 11 may also be a twelve-sided cross sectional area, such as the polyhedron 16 shown in FIG. 5, or as more clearly shown in the section view in FIG. 7. This will produce a drive shaft 11 capable of being gripped to prevent rotational slippage around the longitudinal axis of the drive shaft 11 of the adapter 10 by gripping jaws or chucks compatible with such shapes. With reference to FIG. 8, adapter 10 has a drive shaft 11 with six flat surfaces. The adapter 10 also has a square drive end portion 13 and a truncated quadrangular pyramid 17 as drive end portion 13*c*. The square or extension drive end portion 13 and the drive end portion 13*c* are of such dimensions as to be easily inserted into a socket having a square mating opening or cavity therein. The size of the square cross sectional extension or drive end portion 13 of the adapter 10 is dependent upon the size of the socket receptacle and its square mating cavity or opening therein. Normally, the size will be for $\frac{1}{4}$ inch or $\frac{3}{8}$ inch or $\frac{1}{2}$ inch square cavities or apertures as is standard in such socket tools; however, the size of the adapter may be selected for any size adapter as desired as the size of the adapter is easily constructed to fit any desired receptacle or socket, or any desired torque producing device. The largest size cross sectional size of drive end portion 13*c* is equal to the cross sectional size of drive end portion 13.

The square cross sectional extension or drive end portion 13 of adapter 10 may also be constructed so as to have more than one square cross section extension or other compatibly shaped drive end portions on the same adapter 10 increasing the adaptability and flexibility of the adapter as such combination will fit different size sockets with different size square cavity openings.

FIG. 5 shows elements of drive end portion 13 whereby drive end portions 13*a* and 13*b* are dimensioned longitudinally to minimize the distance necessary for insertion of drive end portion 13*a* into a socket opening to fit drive end portion 13. In certain cases, placement of drive end portion 13*b* immediately preceeding drive end portion 13*a* could prohibit the engagement of drive end portion 13 should drive end portion 13*b* hit a work piece before sufficient insertion into a socket to provide engagement of drive end portion 13. The embodiment of adapter 10 shown in FIG. 5 can be arranged with any other combination positional arrangement with a hexagonal or other combination section drive shaft 11 as shown in FIGS. 3, 4, 6 and 7, arranged on only one end or both ends of adapter 10.

Figure 9:
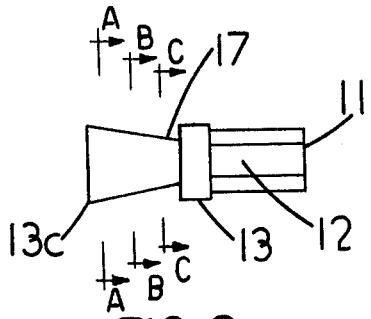
FIG. 9 shows a side view of the perspective view of FIG. 8.
Figure 10:
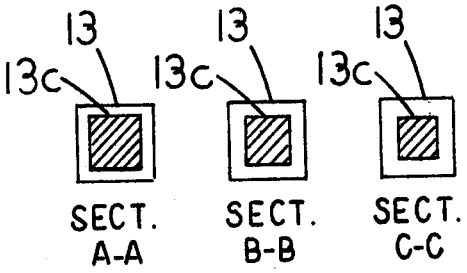
FIG. 10 shows the three sections A—A, B—B and C—C of FIG. 9 showing cross section constructional area details of the truncated quadrangular pyramid drive end portion and its relationship to the full area drive end portion of FIG. 9.

The adapter of preferred configuration having an additional drive end portion thereon is shown in FIG. 8 in which square cross sectional drive end portion 13 of adapter 10 is shown along with a truncated quadrangular pyramid 17. FIG. 9 shows the full square drive end portion 13 with the truncated quadrangular pyramid 17 decreasing in cross sectional size as drive end portion 13*c* from the full square dimension of the drive end portion 13. FIG. 10 shows the decreasing dimensions of cross sectional areas A—A, B—B and C—C of FIG. 9 of drive end portion 13 along with the full dimension square drive end portion 13. In operation, the square drive end portion 13 can be fully inserted into the mating socket tool device or it can be partially inserted to where only a portion of the drive end portion 13*c* is in the square opening aperture of the socket. In the fully inserted position, the centerlines of the mating socket and the adapter tool 10 are coincident for all practical intents and purposes. In the partially inserted, or partially engaged position, the centerline of the mating socket and the centerline of the adapter tool can be angularly arranged with respect to each other as shown in phantom in FIG. 8. In this arrangement, the centerlines are not coincident. The drive end portion 13*c* portion of the truncated quadrangular pyramid 17 allows the truncated quadrangular pyramid 17 to engage the square opening of the socket on non-coincident centerlines thereby permitting use of the adapter in work areas where access for coincident centerline alignment could be difficult or impossible. This movement also allows the centerline of the adapter 10 to move angularly with respect to the centerline of the socket and to swing a limited angle in the manner of a universal joint or coupling. The swinging of the limited angle allows the transmission of rotary motion, or torque, from the adapter 10 to the socket in the same manner as transmitted from one shaft to another shaft not in line with it as in the drive shaft of an automobile. The rotary driving capability and usefulness of the adapter 10 is enhanced with this truncated quadrangular pyramid 17 feature. The action of the truncated quadrangular pyramid 17 of the drive end portion 13 when rotating provides a pulling-on force on the adapter 10 which tends to keep the adapter 10 and the socket in operational engagement.

The use of the rotational energy transmitting adapter 10 is facilitated when a torque imparting rotary force is applied to the drive shaft 11 of the adapter 10 and the torque load is transmitted cooperatively to or through the square cross sectional drive end portion 13 and drive end portion 13*c* to the resistive load of a mating socket tool device engaging a work piece.

It is also possible to transmit rotational energy in reverse direction from the square cross sectional drive end portion 13 to the drive shaft 11 which may be inserted into a socket tool having a mating cavity or opening in it which would resist rotational slippage and would transmit rotational energy. The adapter can be used for a different purpose which would entail use of the adapter as a rotational torque transmitting coupling similar to motor driven shafts or mechanisms needing such coupling.

The drive shaft 11 is inserted into a holding device, such as jaws of a metal chuck, typically a three jaw chuck, such as a Jacobs chuck. The chuck is normally used on reversible or non-reversible, variable or constant speed electric or pneumatic machines or tools such as drill devices. The holding device, which may also be a device such as a lock wrench, an open end wrench, or a box wrench or any other device made for holding drills, bits, taps, cylindrical tools, or square or non-round shanked wood bit type tools, is tightened down to clamp onto the surfaces of the drive shaft 11 of the adapter 10 in a non-slip grip. The jaws when thus tightened down onto flat surfaces 12 cannot turn or slip about the longitudinal axis of the shaft or drive shaft 11 of adapter 10.

Figure 11:
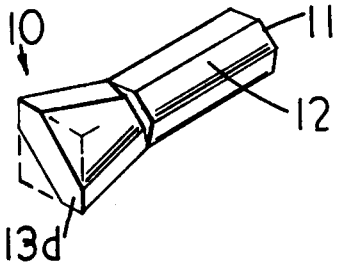
FIG. 11 is a perspective view showing another embodiment of the adapter with a thick blade-like portion drive end portion reduced from a truncated quadrangular pyramid square drive end portion with decreasing sections of a truncated quadrangular pyramid drive end portion.

FIG. 11 shows another embodiment in which a wide blade-like drive end portion 13*d* is shown, but without the square drive end portion 13 shown in FIGS. 8 and 9. The blade-like drive end portion 13*d* is derived to extend from diagonally opposite corners of a square truncated drive end 17 shown in phantom in FIG. 11. The extreme corners of drive end portion 13*d* engage a suitably sized square opening or cavity in a socket tool device for producing desired rotational torque of the socket tool device when the adapter 10 is engaged with non-coincident angularly disposed centerlines or with coincident centerlines of the adapter 10 and the socket tool device.

Figure 12:
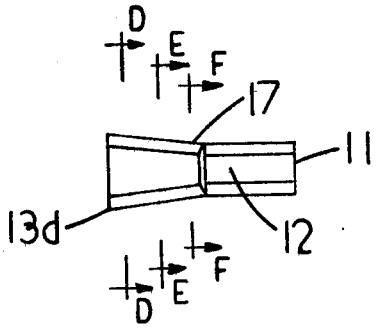
FIG. 12 shows a side view of the perspective view of FIG. 11.
Figure 13:
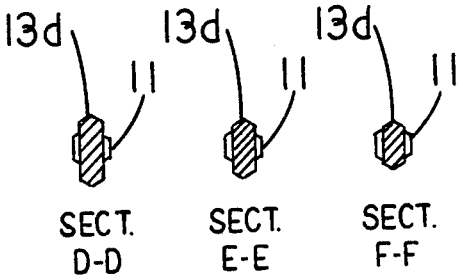
FIG. 13 shows the three sections D—D, E—E and F—F of FIG. 12 showing constructional details of a thick blade-like portion of a truncated quadrangular pyramid and its relationship to the full area drive shaft of FIG. 11.

FIG. 12 shows a portion of the truncated pyramid 17 decreasing in cross sectional size from the full size diagonal dimension of drive end portion 13*d* as shown in FIG. 11. FIG. 13 shows the decreasing dimensions of cross sectional areas D—D, E—E and F—F of the portion of the truncated pyramid 17. The insertion movement of the truncated partial pyramids along with rotational torque production means and motions are the same as those of full square four sided truncated pyramids previously described herein. The capability of accepting and handling coincident and non-coincident centerlines is possessed by the said truncated and non-truncated partial pyramid configurations.

Figure 14:
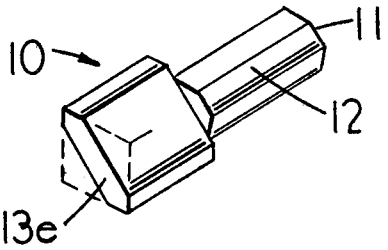
FIG. 14 is a perspective view showing another embodiment of the adapter with a thick blade-like portion drive end portion reduced from a square drive end of constant cross section blade-like shape.

FIG. 14 is a perspective view of another embodiment of adapter 10 showing a wide blade-like drive end portion 13*e* remaining after the removal of material from a typical square drive end portion 13 such as that shown in FIG. 1. The extreme corners of the blade-like drive end portion 13*e* engage a suitably sized square aperture or cavity in a socket tool device for producing desired rotational torque of the socket tool device when adapter 10 is engaged with coincident centerlines of the adapter 10 and the socket tool device.

The surfaces of the various configured drive end portions 13 and or 13*a* through 13*e* can all be made undersized and coated with friction increasing materials like plastic or other elastomeric-like coating materials to give the adapter a frictional socket retention action or holding capability while also increasing the undersize metal condition to desired full size finished drive end dimension.

It is understood that suitable modifications and configurations may be made in the structure as disclosed and such modifications and configurations are only limited to those within the spirit and scope of the appended claims. Having now, therefore, fully illustrated and described my invention, what I claim to be new and desire to protect by Letters Patent is set forth in the appended claims.

What is claimed is:

1. A tool adapter device having an integral hexagonal cross sectional drive shaft with a drive end, said drive end comprising a first and a second square cross-sectional drive end portion, wherein said first drive end portion is disposed between the drive shaft and said second drive end portion, and said first drive end portion is of constant cross-sectional area and said second drive end portion is comprised of a frustrum of a quadrangular pyramid which decreases from a cross-sectional area equal to the cross-sectional area of the first described drive end portion to decreasing cross-sectional areas decreasing in size in the direction toward and fixedly joined to said first described nonreducing cross-sectional area drive end portion, said first drive end portion operating cooperatively with the largest and equal-size square area of the second drive end portion which is placed on the opposite end of the device from said drive shaft to align coincidentally the centerlines of said adapter device and a socket tool when both drive end portions are slidably inserted into a square aperture or said socket tool to enable in-line rotational motion at low and relatively high speeds, of clockwise and counterclockwise direction, of continuous and non-continuous rotation of said adapter device and said socket tool each about their respective coincident centerlines, whereby said frustrum of the quadrangular pyramid of said second drive end portion operating to transmit rotational motion at low and relatively high speeds, of clockwise and counterclockwise direction, of continuous and noncontinuous rotational motion of said tool adapter and the socket tool mated thereon, when said frustrum portion of the second drive end portion is partially slidably inserted into the square aperture of said socket tool thereby creating a hold-on force means and a "universal-joint" type swivel action allowed by the spatial clearance between said socket tool square aperture and said frustrum of the quadrangular pyramid, said second drive end portion and said socket tool each rotating about its own respective centerline with the centerlines of said second drive end portion and said socket tool being non-coincident and angularly disposed to each other.

* * * * *